US005141618A

United States Patent [19]

Cabaraux et al.

[11] Patent Number: 5,141,618

[45] Date of Patent: Aug. 25, 1992

[54] FRAME UNIT FOR AN ELECTROLYSER OF THE FILTER PRESS TYPE AND ELECTROLYSERS OF THE FILTER-PRESS TYPE

[75] Inventors: Emile Cabaraux; Eric Paulus, both of Brussels, Belgium

[73] Assignee: Solvay & Cie., Brussels, Belgium

[21] Appl. No.: 773,976

[22] Filed: Oct. 8, 1991

Related U.S. Application Data

[63] Continuation of Ser. No. 528,715, May 24, 1990.

[30] Foreign Application Priority Data

May 29, 1989 [FR] France ..... 89 07142

[51] Int. Cl.[5] ..... C25B 9/00

[52] U.S. Cl. ..... 204/257; 204/253; 204/252; 204/283; 204/290 R; 204/279

[58] Field of Search ..... 204/257, 253, 252, 279

[56] References Cited

U.S. PATENT DOCUMENTS

| | | | |
|---|---|---|---|
| 4,069,129 | 1/1978 | Sato et al. | 204/257 |
| 4,309,264 | 1/1982 | Bender et al. | 204/256 |
| 4,643,818 | 2/1987 | Seku et al. | 204/257 |
| 4,654,136 | 3/1987 | Dang et al. | 204/252 |
| 4,666,580 | 5/1987 | Beaver et al. | 204/254 |
| 4,734,180 | 3/1988 | Sato et al. | 204/254 |

*Primary Examiner*—John Niebling
*Assistant Examiner*—Kishor Mayekar
*Attorney, Agent, or Firm*—Robert E. Burns; Emmanuel J. Lobato

[57] ABSTRACT

Frame unit for an electrolyser of the filter-press type, comprising a vertical metal sheeting (1), a peripheral frame made up of two vertical uprights (2, 3) and of two horizontal lengthwise members (4, 5) and a metal sheet (6) covering the sheeting (1) and the two uprights (2, 3), the two lengthwise members (4, 5) being made of the same material as the sheet (6), being inserted between the uprights (2, 3) and being firmly attached to the sheet (6). Electrolysers of the filter-press type comprising this frame unit.

9 Claims, 8 Drawing Sheets

FRAME UNIT FOR AN ELECTROLYSER OF THE FILTER PRESS TYPE AND ELECTROLYSERS OF THE FILTER-PRESS TYPE

This is a continuation of application Ser. No. 07/528.715, filed May 24, 1990.

The invention relates to electrolysers of the filter-press type and more particularly to frame units forming part of the structure of these electrolysers.

Electrolysers of the filter-press type are generally made up of a stack of vertical units which define electrolysis chambers in which electrodes are arranged vertically. Membranes with selective permeability or diaphragms which are permeable to the electrolytes can be inserted between the frame units, to separate the electrolysis chambers.

In document U.S. Pat. No. 4,069,129 (Asahi Glass Company) electrolysers of the filter-press type are described, in which the frame units are frames made up of an assembly of tubes which are employed for the circulation of electrolytes and of electrolysis products. The electrodes are perforated metal plates which are attached to the frames along the periphery. In these known electrolysers the tubes making up the frames must be made of a material which withstands the chemical and thermal conditions prevailing in the electrolyser; they are generally made of titanium or of nickel, depending on whether they are in an anode chamber or in a cathode chamber of a membrane cell used for the electrolysis of aqueous sodium chloride solutions. However, titanium and nickel have the disadvantage of exhibiting a high electrical resistivity when compared with materials such as steel, copper or aluminium, so that these electrolysers exhibit poor energy efficiencies.

Documents EP-A-185,271 (Oronzio de Nora) and WO 86/3,787 (Dow Chemical) describe electrolysers of the filter-press type, in which the frame units comprise a vertical metal plate and a peripheral frame, the whole being jacketed with a pressed metal sheet. The sheeting is employed to convey the electrical current towards the electrodes and is consequently generally made of steel, copper or aluminium. The pressed sheet is used to isolate the sheeting and the frame from the corrosive chemical environment present in the electrolyser; it is made of titanium or nickel, depending on whether it is situated in an anode chamber or in a cathode chamber of a membrane cell for the electrolysis of aqueous sodium chloride solutions. In these known electrolysers the frame units exhibit a low resistance to the conduction of the electrical current, and this constitutes an advantage. However, these frame units have the disadvantage that their frame cannot be employed for the circulation of electrolytes and of the electrolysis products, owing to the fact that it is entirely covered by the pressed metal sheet.

The invention is aimed at providing a frame unit for an electrolyser of the filter-press type, which combines the corresponding advantages of the known electrolysers described above, while avoiding their disadvantages. It is aimed more particularly at providing a frame unit exhibiting a low overall resistance to the conduction of the electrical current, and in which a part of the frame can be employed for the circulation of electrolytes and of the electrolysis products.

Consequently, the invention relates to a frame unit for an electrolyser of the filter-press type, comprising a vertical metal plate jacketed with a metal sheet and a peripheral frame made up of two vertical uprights and of two horizontal lengthwise members; according to the invention the two uprights are attached to the metal plate and are covered with the metal sheet, and the two lengthwise members are made of the same material as the sheet, are inserted between the uprights and are attached to the sheet.

In the frame unit according to the invention the function of the frame is to define an electrolysis chamber of the electrolyser, this chamber being intended to contain a vertical electrode.

The function of the metal plate is to stiffen the frame unit, to support the frame and to conduct the electrical current through the electrolyser. The material of the metal plate is not critical, provided that it is electrically conductive. However, it is especially recommended to make it of a metal or metal alloy which is a good conductor of electricity; steel, copper and aluminium are preferred.

The material employed for the side uprights of the frame is not critical.

The function of the metal sheet is to isolate the metal plate and the uprights of the frame from the corrosive chemical environment present in the electrolyser. It must therefore be made of a material which is impermeable to the corrosive constituents of this environment and inert towards them. By way of example, in the case of membrane electrolysers intended for the production of chlorine and of aqueous sodium hydroxide solutions, a material chosen from titanium, tantalum, niobium, zirconium, tungsten and alloys of these metals may be employed when the frame unit is intended to form an anode chamber of the electrolyser; when the frame unit is intended to form a cathode chamber of the electrolyser the material of the metal sheet is advantageously chosen from nickel and nickel alloys. The metal sheet must, furthermore, be profiled so that it rests on the metal plate, between the uprights, and straddles the uprights. Consequently, the profile to be imparted to the sheet depends on the dimensions and the shape of the lengthwise members and may be obtained by a pressing or folding operation. The thickness of the sheet must be sufficient for it to withstand the mechanical stresses to which it is subjected when the electrolyser is in operation. Notwithstanding this condition, there is advantage in employing a sheet which is as thin as possible, so that its electrical resistance, transversely to its surface, is as low as possible. The optimum thickness may be easily determined as soon as its other dimensions, the material of which it is made and the operating conditions of the electrolyser are fixed.

The horizontal lengthwise members of the frame must be made of a material which withstands the corrosive chemical environment present in the electrolyser. It is preferred to make them of the same material as the metal sheet. Furthermore, they must be firmly attached to the metal sheet in a sufficiently leakproof manner in order to isolate the metal plate and the uprights of the frame unit from the corrosive environment present in the electrolyser. The attachment of the lengthwise members to the metal sheet is usually obtained by welding.

The frame unit according to the invention is intended to be joined up to similar frame units to form an electrolyser of the filter-press type. In the latter, the frame unit according to the invention is used to define an electrolysis chamber containing a vertical electrode. The electrode is generally made of metal and may be connected to the metal sheet by means of electrically conductive connectors. The latter may be, for example, metal tenons or beams welded to the electrode and to the metal sheet. It is recommended that the metal sheet should be welded to the metal plate , under the connectors, to reduce the electrical resistance of the assembly.

In accordance with a particular embodiment of the invention, the frame unit comprises, on the one hand, a metal sheet and a peripheral frame on each face of the metal plate and, on the other hand, two vertical electrodes arranged respectively on both sides of the sheeting and connected respectively to the metal sheets by electrically conductive connectors. In the case of a frame intended for a monopolar electrolyser, the two electrodes are two anodes or two cathodes; the two metal sheets can then be made of the same single material and the metal plate must be extended by a metal strip extending outside the frame, to be connected to a source of electrical current. In the case where the frame is intended for an electrolyser of the bipolar type, one electrode is an anode and the other electrode is a cathode, the metal plate then being used to transfer the electrical current from the cathode towards the anode when the electrolyser is in operation.

In the frame unit according to the invention, the uprights and the lengthwise members of the frame may have any cross-section compatible with the structure of the electrolysers. It is preferred to give them a polygonal, generally square, rectangular or trapezoidal cross-section.

In an advantageous embodiment of the frame unit according to the invention, the lengthwise members are profiled so as to form, along the sheet, two lengthwise channels which are pierced with openings on their respective walls which face each other; one of the channels, furthermore, is connected to an electrolyte entry conduit, the other channel being connected to a conduit for discharging the electrolysis products. In this embodiment of the invention the channels of the lengthwise members are used to distribute the electrolyte into the electrolysis chamber defined by the frame and to remove therefrom the products resulting from the electrolysis.

As explained above, the frame unit according to the invention may be adapted to the construction of monopolar electrolysers or of bipolar electrolysers.

The invention consequently also relates to monopolar electrolysers of the filter-press type and to bipolar electrolysers of the filter-press type which are made up of a stack of frame units in accordance with the invention, the said frame units defining electrolysis chambers which contain electrodes. The invention applies very particularly to electrolysers of this type, in which the electrolysis chambers are separated by ion-permeable separators. Separators are sheets inserted between the successive frame units of the stack and made of a material through which an ion current can pass when the electrolyser is in operation. They may be diaphragms which are permeable to aqueous electrolytes or selectively permeable membranes, the difference being of no consequence.

Examples of diaphragms which can be employed in the electrolysers according to the invention are asbestos diaphragms such as those described in U.S. Pat. No. 1,855,497 (Stuart) and in Patents FR-A-2,400,569, EP-A-1,644 and EP-A-18,034 (Solvay & Cie) and diaphragms made of organic polymers, such as those described in Patents FR-A-2,170,247 (Imperial Chemical Industries PLC) and in Patents EP-A-7,674 and EP-A-37,140 (Solvay & Cie).

Selectively permeable membranes mean thin, nonporous membranes comprising an ion exchange substance. The choice of the material forming the membranes and the ion exchange substance will depend on the nature of the electrolytes subjected to electrolysis and of the products which it is intended to obtain. As a general rule the mater-al of the membranes is chosen from those which are capable of withstanding the thermal and chemical conditions which normally prevail in the electrolyser during the electrolysis, the ion exchange substance being chosen from anion exchange substances or cation exchange substances, depending on the electrolysis operations for which the electrolyser is intended.

For example, in the case of electrolysers intended for the electrolysis of aqueous sodium chloride solutions for the production of chlorine, hydrogen and aqueous sodium hydroxide solutions, suitable membranes are cation membranes made of fluorinated, preferably perfluorinated, polymer containing cationic functional groups derived from sulphonic acids, from carboxylic acids or from phosphonic acids or from mixtures of such functional groups. Examples of membranes of this type are those described Patents GB-A-1,497,748 and GB-A-1,497,749 (Asahi Kasei Kogyo K.K.), GB-A-1,518,387, GB-A-1,522,877 and U.S. Pat. No. 4,126,588 (Asahi Glass Company Ltd) and GB-A-1,402,920 (Diamond Shamrock Corp.). Membranes which are particularly suited for this application of the cell according to the invention are those known by the names "Nafion" (Du Pont de Nemours & Co) and "Flemion" (Asahi Glass Company Ltd).

The electrolysers according to the invention find an especially advantageous application for the production of chlorine and of aqueous sodium hydroxide solutions by electrolysis of aqueous sodium chloride solutions.

Special features and details of the invention will emerge from the description which follows, with reference to the attached drawings.

In these figures, the same reference numbers denote identical components.

In the description which follows, the invention is applied specifically to electrolysers of the filter-press type with cation membranes, for the production of chlorine and aqueous sodium hydroxide solutions by electrolysis of aqueous sodium chloride solutions.

Figure 1:
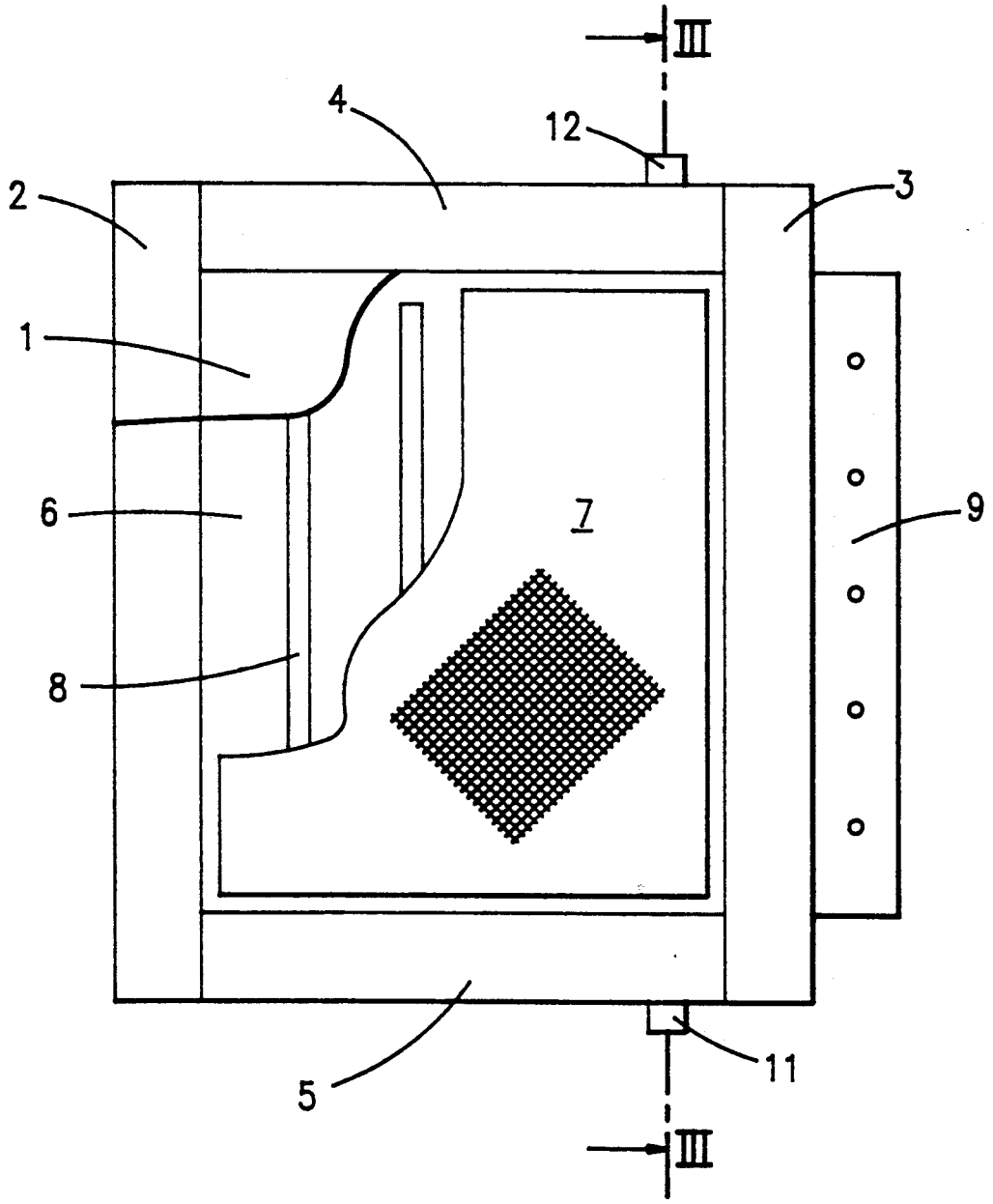
FIG. 1 is an elevation view, with partial cutaway, of an embodiment of the frame unit according to the invention.
Figure 2:
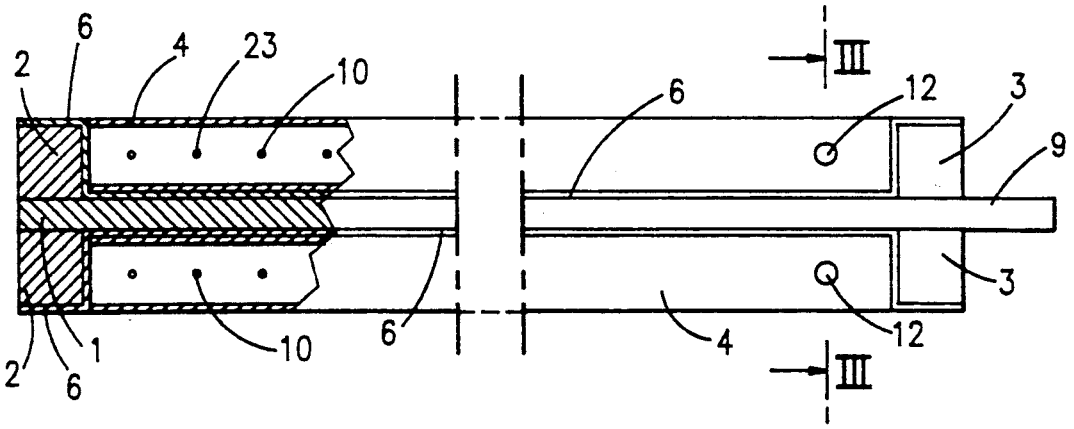
FIG. 2 is a plan view, with partial cutaway, of the frame unit of FIG. 1.
Figure 3:
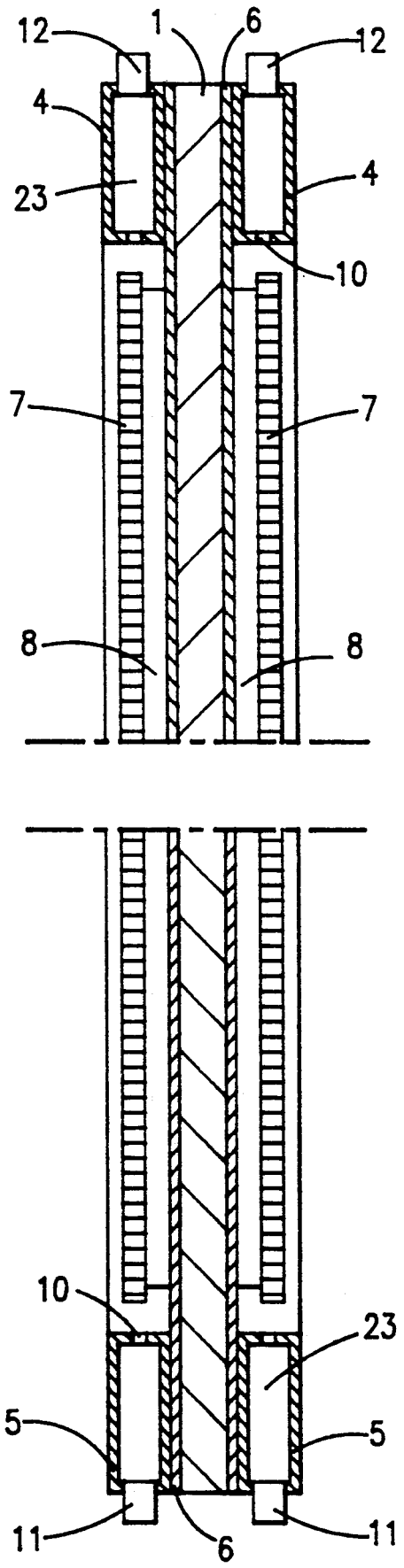
FIG. 3 is a vertical section along the plane III—III of FIGS. 1 and 2.

The frame unit in accordance with the invention, shown in FIGS. 1 to 3, is designed to form two twinned anode chambers of a monopolar electrolyser. It comprises a vertical plate 1 made of copper and to peripheral frames arranged respectively on both sides of the plate 1. The frames are rectangular in cross-section. Each comprises two vertical uprights 2 and 3, made of copper or steel, which are welded to the plate 1, and two lengthwise members 4 and 5, made of titanium. The plate is jacketed in two titanium sheets 6 folded in the shape of an Ω, so that they are applied onto the plate 1 under the horizontal members 4 and 5 and straddle the uprights 2 and 3. The titanium sheets 6 are welded to the lengthwise members 4 and 5 by means of continuous welding runs, so as to form a leakproof assembly. Two vertical anodes 7 (which can be seen in FIGS. 1 and 3) are arranged respectively inside the frames. Each consists of a vertical perforated titanium plate carrying a conductive coating with a low overvoltage for the electrochemical oxidation of chloride ions. Such coatings are well known in electrolysis technology. Each anode 7 is attached to the sheet 6 by means of vertical titanium beams 8. The plate 1 is extended outside the frame units in the form of a marginal strip 9 intended to be connected to the positive terminal of a direct current source. The electrical connection between the source of current (not shown) and the anode plates 7 is made via the marginal strip 9, the metal plate 1, the titanium sheets 6 and the beams 8. The electrical connection between the metal plate 1 and -he sheets 6 may be obtained by the action of the hydrostatic pressure of the electrolyte when the electrolyser is in operation; alternatively, welding points of the sheets 6 to the metal plate 1 may be provided under the beams 8.

The tubular lengthwise members 4 and 5 are tubes of rectangular section, thus defining four lengthwise channels 23. Their ends are welded hermetically to the sheets 6. Furthermore, they are pierced with uniformly spaced openings 10 in their walls which face each other. The lower tubular lengthwise members 5 are fitted with a pipe 11 for allowing an aqueous sodium chloride solution which is to be electrolysed to enter their respective channels 23; similarly, the upper lengthwise members 4 are fitted wit[a pipe 12 for discharging the electrolysis products. In this case chlorine and a dilute sodium chloride solution.

Figure 4:
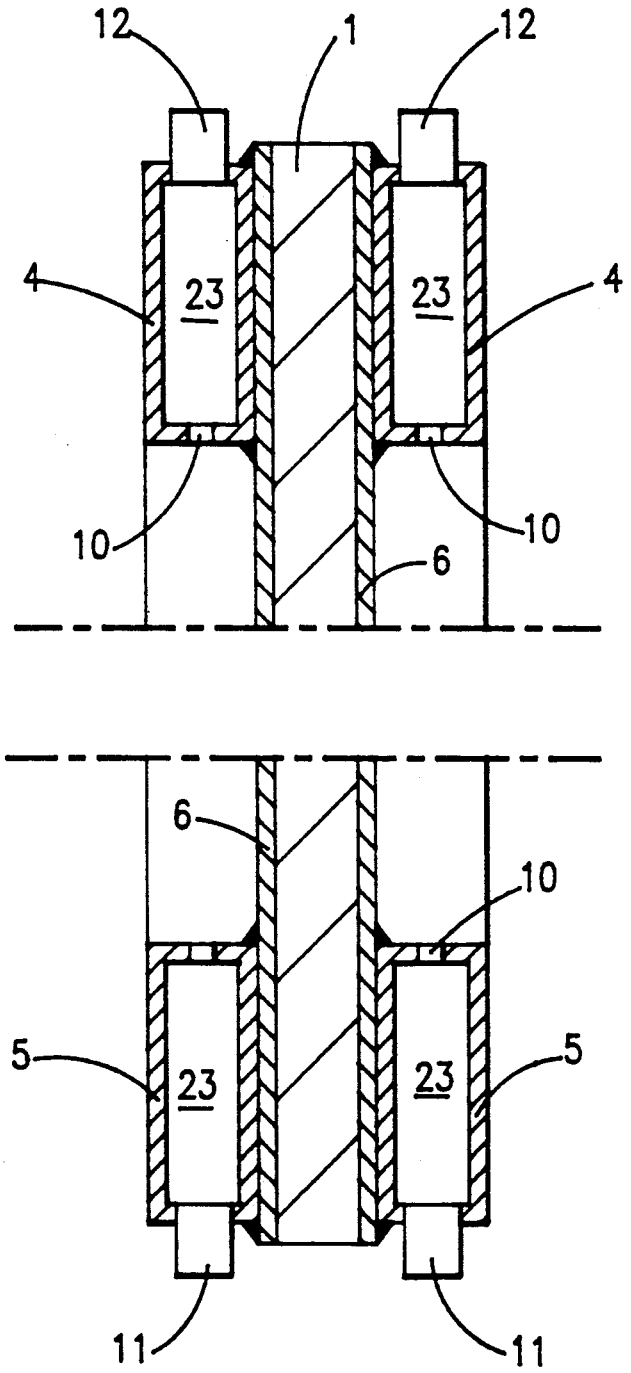
FIG. 4 shows an alternative embodiment of a detail of FIG. 3.

In the alternative embodiment shown in FIG. 4, each of the lengthwise members 4 and 5 is made up of a titanium plate-rolled into a U and welded to the titanium sheet 6 so as o define the channel 23.

In the case of a frame unit intended to form two twinned cathode chambers of the electrolyser, the horizontal lengthwise members 4 and 5, the sheets 6, the beams 8 and the plates 7 (making up the cathodes) are made of nickel The nickel plates 7 may advantageously carry a conductive coating with a low overvoltage for electrochemical reduction of protons; such coatings are well known in electrolysis technology.

Figure 5:
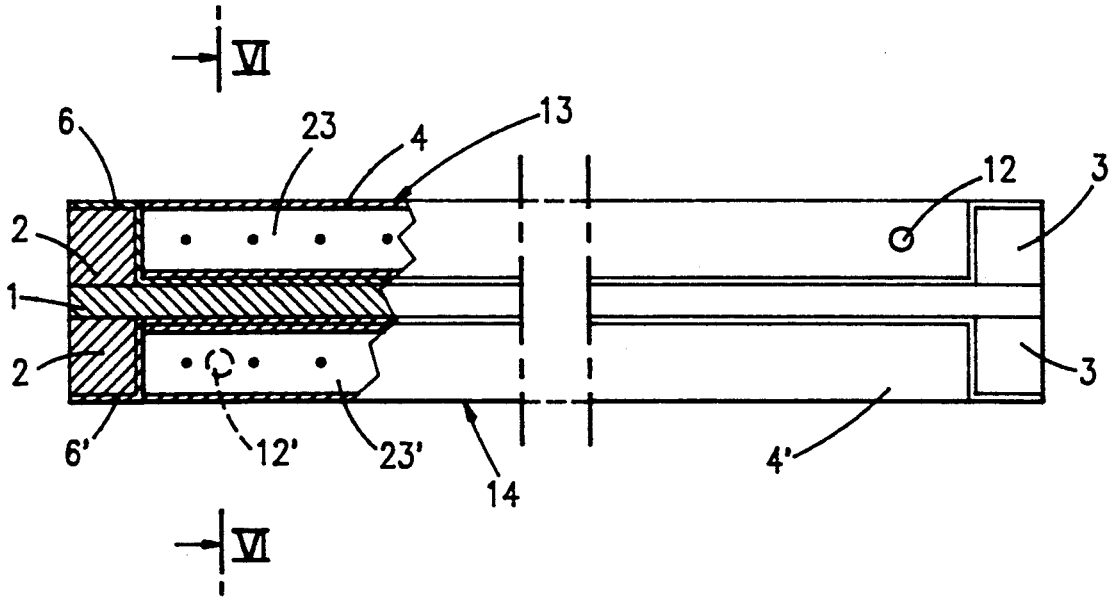
FIG. 5 is a plan view similar to FIG. 2, with partial cutaway, of another embodiment of the frame unit according to the invention.
Figure 6:
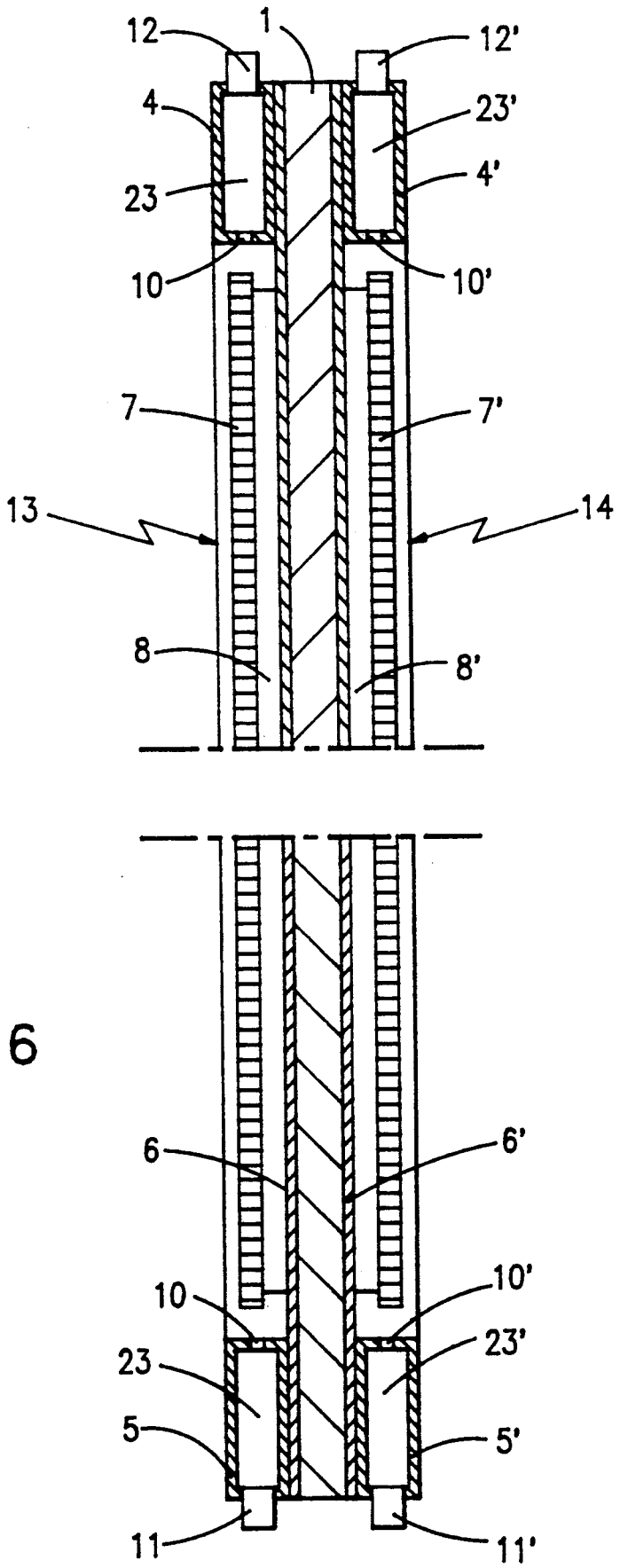
FIG. 6 is a section along plane VI—VI of FIG. 5.

The frame unit in accordance with the invention, shown in FIGS. 5 and 6, is designed to form two twinned chambers, anode 13 and cathodic 14 respectively, of a bipolar electrolyser To this end, it has the same spatial configuration as the frame units of FIGS. 1 to 3 and it also comprises a vertical plate 1 made of copper and, on each face of the latter, two vertical uprights 2 and 3 made of copper or of steel, which are welded to the plate 1. The anode chamber 13 is arranged like each of the twinned anode chambers of the frame unit of FIGS. 1 to 3. It comprises a titanium sheet 6 covering the plate 1 and the two uprights 2 and 3, two titinium lengthwise members 4 and 5 perforated with a line of openings in their walls which face each other, opposite the titanium sheet 6 and a titanium anode (carrying an active coating for the electrochemical oxidation of chloride ions) which is attached to the sheet 6 by the titanium beams 8. In the cathode chamber 14 the metal plate 1 and the two vertical uprights 2 and 3 are covered with a nickel sheet 6'. The two tubular lengthwise members 4' and 5' (which are perforated by a line of openings 10' in their walls which face each other), the plate 7' and the beams 8' are made of nickel. The nickel cathode plate 7' is preferably provided with an active coating for the electrochemical reduction of protons. The pipe 11' is used to permit the entry of water or of a dilute aqueous sodium hydroxide solution into the channel 23' defined by the lower lengthwise member 5' and the pipe 12' is used for removing the electrolysis products (in this case hydrogen and a concentrated aqueous sodium hydroxide solution) out of the channel 23' defined in the upper tubular lengthwise member 4'.

Figure 7:
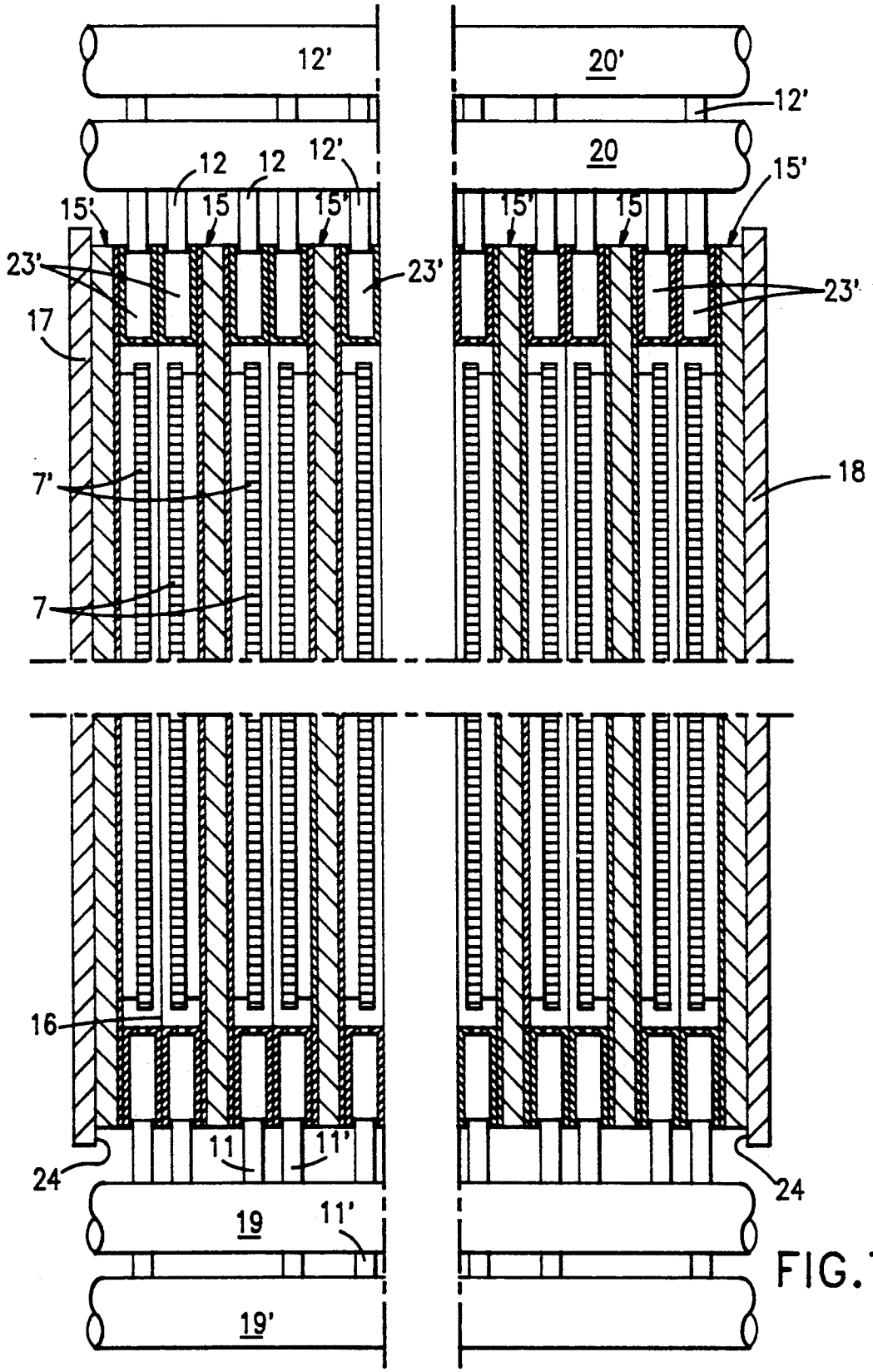
FIG. 7 shows, in vertical cross-section, a monopolar electrolyser of the filter-press type, in accordance with the invention.

The electrolyser shown in FIG. 7 is of the monopolar type. It is made up of a stack of vertical, alternately anodic 15 and cathodic 15', frame units. The anode frame units 15 are similar to those described above with reference to FIGS. 1 to 3. The cathode frame units 15' are similar to the anode frame units 15, in which the components made of titanium have been replaced with similar components made of nickel. These nickel components of the frame unit 15' bear the same reference numbers as their corresponding homologues of the frame unit 15, but are given a prime mark (').  At each end, the electrolyser ends in a cathode half-frame unit 15'. The frame units 15 and 15, are separated by cation membranes 16, which thus define alternately anodic and cathodic electrolysis chambers. The stack of the frame units 15 and 15' and of the membranes 16 is held between end flanges 17 and 18, which are connected by tie rods, not shown. Sheets 24 made of an electrically non-conductive material provide electrical insulation between the flanges 17 and 18 and the end half-frame units 15' of the electrolyser. The marginal strips 9 (FIG. 2) of the metal plates 1 of the anode frame units 15 are connected to a common. busbar, joined to the positive terminal of a source of direct current, the marginal strips 9, the busbar and the source of current not being shown in FIG. 7. Similarly, the marginal strip of the plates 1 of the cathode frame units 15' are connected to a common busbar joined to the negative terminals of the source of direct current. Furthermore, the pipes 11 and 12 of the anode frame units 15 emerge respectively into a common entry manifold 19 for an aqueous sodium chloride solution and into a manifold 20 used for discharging an emulsion of chlorine in a dilute aqueous sodium chloride solution. By analogy, bipolar electrolyser of the filter-press type, in accordance the pipes 11' and 12' of the cathode frame units 15' emerge respectively into two .general manifolds 19' and 20', the manifold 19' being used to allow the entry of water or of a dilute sodium hydroxide solution into the cathode chambers and the manifold 20' being used for the removal of the hydrogen produced during the electrolysis and of a concentrated sodium hydroxide solution.

Figure 8:
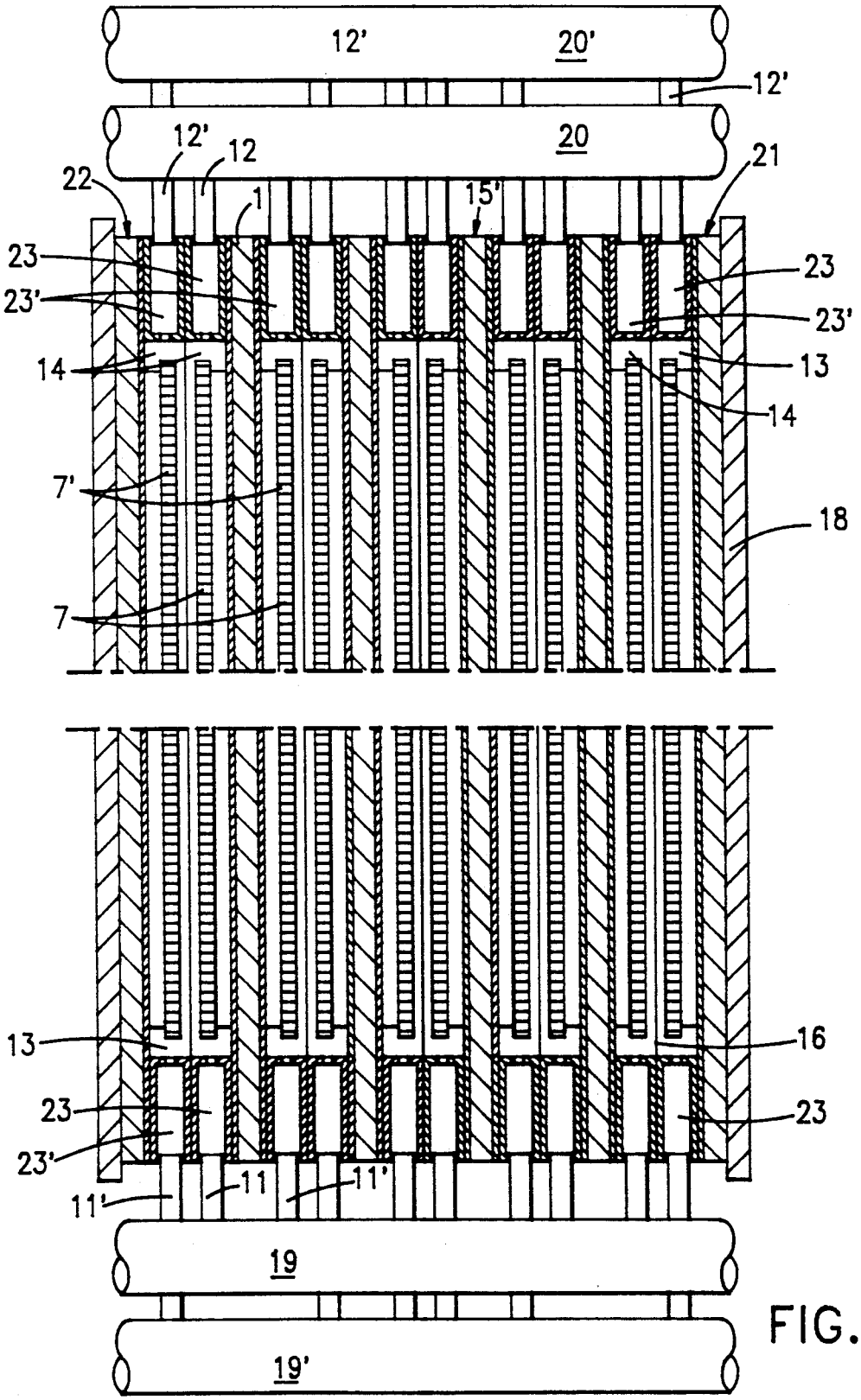
FIG. 8 shows, in vertical cross-section, a bipolar electrolyser of the filter-press type, in accordance with the invention.

The electrolyser shown in FIG. 8 is of the bipolar type. It is made up of a stack of frame units in accordance with that shown in FIGS. 5 and 6 and of cation membranes 16, so as to define alternately anodic 13 and cathodic 14 electrolysis chambers. At its ends, the electrolyser terminates in two half-frame units, anodic 21 and cathodic 22 respectively. The metal plate 1 positive terminal of a source of direct current, not shown, and the plate 1 of the cathodic half-frame units 22 is connected to the negative terminal of the source of current.

We claim:

1. A frame unit for use in an electrolyser of the filter-press type in conjunction with other similar frame units, said frame unit comprising an electrically conductive flat polygonal metal plate disposed vertically, said metal plate being of metal which has good electrical conductivity but is not resistant to corrosive chemicals, a sheet metal jacket jacketing said metal plate, said sheet metal jacket comprising two sheets of metal which are disposed on opposite faces of said metal plate and which are of a metal which is resistant to chemical corrosion, two peripheral frames disposed respectively on opposite sides of said jacketed metal plate, each frame comprising a pair of upright members of polygonal cross section attached to marginal portions of said metal plate and of a metal having good electrical conductivity and a pair of horizontal lengthwise members of polygonal cross section extending between said pair of upright members of a corresponding frame along a top and a bottom of said jacketed metal plate, outside of said jacket, and made of a metal the same as said sheet metal jacket, said sheet metal jacket extending over vertical surfaces of said upright members facing toward said horizontal lengthwise members of each said frame and extending over vertical side surfaces of said upright members parallel with said jacketed metal plate and facing away therefrom, and fluid-tight seals attaching said horizontal lengthwise members to said sheet metal jacket to form a leak proof assembly, each of said horizontal lengthwise members defining n elongate channel and having, on a side facing an opposite horizontal lengthwise member, a plurality of openings spaced longitudinally of said horizontal lengthwise member.

2. A frame unit according to claim 1, further comprising vertical beams on opposite sides of said jacketed metal plate, and vertical electrodes mounted on said beams on opposite sides of said jacketed metal plate and spaced therefrom.

3. A frame unit according to claim 1, further comprising means for effecting an electrical connection to said jacketed metal plate.

4. A frame unit according to claim 3, in which said means for effecting an electrical connection to said jacketed metal plate comprises a marginal strip of said plate extending out of said peripheral frames.

5. A frame unit according to claim 1, in which said metal jacket comprises two titanium metal sheets disposed on opposite sides of said metal plate folded to cover said vertical and side surfaces of the upright members of said two frames.

6. An electrolyser of the filter-press type comprising at least two frame units disposed side-by-side, each frame unit comprising, an electrically conductive polygonal flat metal plate disposed vertically, a sheet metal jacket jacketing said metal plate, said sheet metal jacket comprising two sheets of metal which ar disposed on opposite faces of said metal plate and which are of a metal which is resistant to chemical corrosion, two peripheral frames disposed respectively on opposite sides of said jacketed metal plate, each frame comprising a pair of upright members of polygonal cross section attached to marginal portions of said metal plate and of a metal having good electrical conductivity and a pair of horizontal lengthwise members of polygonal cross section extending between said pair of upright members of a corresponding frame along a top and a bottom of said jacketed metal plate, outside said jacket, and made of a metal the same as said sheet metal jacket, said metal sheet jacket extending over vertical surfaces of said upright members facing toward said horizontal lengthwise members of each said frame and extending over vertical side surfaces of said upright members parallel with said jacketed metal plate and facing away therefrom, and fluid-tight seals attaching said horizontal lengthwise members to said sheet metal jacket to form a leakproof assembly, each of said horizontal lengthwise members defining an elongate channel and having, on a side facing an opposite horizontal lengthwise member, a plurality of openings spaced longitudinally thereon, vertical beams on opposite sides of the jacketed metal plate, and vertical electrodes mounted on said beams on opposite sides of the jacketed metal plate and spaced therefrom.

7. An electrolyser according to claim 6, including a diaphragm between said two frame units.

8. A frame unit for use in an electrolyser of the filter-press type in conjunction with other like frame units, said frame unit comprising a flat rectangular metal plate disposed vertically, said plate being of a metal which has good electrical conductivity but is not resistant to corrosive chemicals, two upright frame members extending respectively along opposite vertical edges of said plate on each of opposite faces of said plate, said upright frame members being secured to said plate and being of a metal which has good electrical conductivity, but is not resistant to corrosive chemicals, a sheet metal jacket jacketing said metal plate and said upright frame members, said jacket comprising two sheets of metal which cover respectively opposite faces of said plate and cover said upright frame members, said metal sheets being of a metal which is resistant to corrosive chemicals, upper and lower frame members extending respectively along upper and lower horizontal edges of said jacketed metal plate on each of opposite faces of said metal plate, said upper and lower frame members being of metal resistant to corrosive chemicals and being tubular to provide internal channels, a plurality of openings in a lower side of said upper frame member and a plurality of openings in an upper side of said lower frame member and means for connecting said tubular upper and lower frame members to external fluid circuitry.

9. A frame unit according to claim 8, further comprising electrodes on opposite sides of said jacketed metal plate and a plurality of metal beams attaching said electrodes to said jacketed metal plate, said beams being of metal resistant to corrosive chemicals.

* * * * *